US005242081A

United States Patent [19]

van der He den et al.

[11] Patent Number: 5,242,081

[45] Date of Patent: Sep. 7, 1993

[54] DUAL LIQUID DISPENSING SYSTEM

[75] Inventors: Lambertus G. van der He den, Bunnik; Robert E. Tiepel, Baarn; Gerrit K. Bunschoten, Oud Zuilen, all of Netherlands

[73] Assignee: Lever Brothers Company, Division of Conopco, Inc., New York, N.Y.

[21] Appl. No.: 17,458

[22] Filed: Feb. 11, 1993

Related U.S. Application Data

[63] Continuation of Ser. No. 680,175, Apr. 3, 1991, abandoned.

[30] Foreign Application Priority Data

Apr. 3, 1990 [GB] United Kingdom ..... 9007441.0

[51] Int. Cl.[5] ..... B67D 5/52

[52] U.S. Cl. ..... 222/1; 222/135; 222/214

[58] Field of Search ..... 222/64–67, 222/135, 136, 144.5, 181, 183, 185, 207, 214; 137/113

[56] References Cited

U.S. PATENT DOCUMENTS

| | | | |
|---|---|---|---|
| 2,695,117 | 11/1954 | Daniels | 222/214 |
| 3,055,551 | 9/1962 | Johnson | 222/66 X |
| 3,140,012 | 7/1964 | Hansen | 222/135 X |
| 4,256,242 | 3/1981 | Christine . | |
| 4,271,987 | 6/1981 | Eriksson et al. | 222/214 X |
| 4,275,823 | 6/1981 | Credle, Jr. | 222/136 X |
| 4,393,982 | 7/1983 | Kuckens | 222/214 X |
| 4,467,941 | 8/1984 | Du | 222/66 X |
| 4,493,435 | 1/1985 | Hartley | 222/136 X |
| 4,573,612 | 3/1986 | Maddison et al. . | |
| 4,795,061 | 1/1989 | Peckjian | 222/66 |
| 4,898,303 | 2/1990 | Large et al. | 222/65 |

FOREIGN PATENT DOCUMENTS

| | | |
|---|---|---|
| 109180 | 5/1984 | European Pat. Off. . |
| 0110686 | 6/1984 | European Pat. Off. . |
| 8903803 | 5/1989 | World Int. Prop. O. . |

*Primary Examiner*—Kevin P. Shaver
*Attorney, Agent, or Firm*—A. Kate Huffman

[57] ABSTRACT

A dual dispensing system for delivering aliquots of a liquid product comprising a housing, two collapsible reservoirs for the liquid product, two manually operated pumps, each of which is connected to one of the collapsible reservoirs and a means to switch over from one pump to another. The switch over means is automatically activated by the vacuum in one of these collapsible reservoirs when the liquid product therein is exhausted and it is fully collapsed.

6 Claims, 5 Drawing Sheets

DUAL LIQUID DISPENSING SYSTEM

This is a continuation of application Ser. No. 07/680,175, filed Apr. 3, 1991, now abandoned.

FIELD OF THE INVENTION

The present invention is concerned with a dispenser of the kind for delivering aliquots of a liquid product from a reservoir by means of a pump which is manually operable. Such dispensers are often used in washrooms, etc. for dispensing small amounts of a liquid soap product for hand washing purposes.

BACKGROUND OF THE INVENTION

Various dispensers of this kind have been described in the literature. For example, the U.S. Pat. No. 4,256,242 (Christine) discloses a liquid soap dispenser comprising a housing, a collapsible bag for holding the liquid soap product and an operating lever or handle for actuating controlled amounts of soap from the bag. The collapsible bag is connected to an outlet by means of a flexible conduit which comprises a pump.

These known type of dispensers offer hygiene and ease of handling for the user. However, one problem with this kind of dispensers resides in the fact that only a small amount of liquid soap may be dispensed at a time, due to the limited capacity of the pump. The amount is usually not more than 0.5 to 1 ml.

Another problem which is commonly encountered is the fact that the dispenser may run out of soap unnoticed, which causes annoyance and hygiene risks for the user. Frequently checking by janitors will reduce the likelihood of a soap dispenser being out of soap for a long time, but this is not an economical solution.

It has also been suggested in the European patent application 110,686 (Kimberley-Clark) to provide the soap dispenser with a window through which the reservoir level may be seen. This offers only a partial solution to the above mentioned problems, because it is not possible to determine when exactly the reservoir will run out of soap. It may even lead to a waste of liquid soap product if it becomes customary to replace the reservoirs before they are completely emptied.

SUMMARY OF THE INVENTION

It is therefore an object of the present invention to provide a dispenser of the aforementioned kind, which does not possess these or other disadvantages.

We have now found that these disadvantages can be overcome by the dual dispensing system for delivering aliquots of a liquid product, comprising a housing, two reservoirs for the liquid product, each reservoir being connected to a pump which can be manually operated via actuating means, whereby there are provided means to automatically switch-over from one pump to the other pump when the liquid product in the first reservoir is exhausted, and vice versa.

Preferably, the reservoirs are collapsible and the switch-over means is actuated by the vacuum which is created in a reservoir when it is fully collapsed.

The dispensing system according to the invention preferably comprises indicating means to indicate that a switch-over has occurred. It is especially preferred that these indicating means are visual indicating means.

The pumps may be of any suitable kind, but bellow-type pumps are preferred. They may have a capacity of from about 0.1 to 10 ml, preferably from about 1 to 5 ml.

BRIEF DESCRIPTION OF THE INVENTION

The invention will now be better explained by way of the following preferred embodiment, and with reference to the accompanying drawings, in which:

FIGS. 1 A, B and C show schematic cross-sectional views of a liquid soap dispenser according to the invention, as seen from the side, the front and from below, respectively;

FIGS. 2 A, B and C show the same dispenser, upon pressing the operating lever;

FIGS. 3 A, B and C show the same dispenser, upon releasing the operating lever;

FIGS. 4 A, B and C show the same dispenser whereby the switch-over means switches from the first collapsible reservoir to the second; and FIGS. 5 A, B and C show the same dispenser after the switch-over has occurred.

DESCRIPTION OF THE PREFERRED EMBODIMENTS

Figure 1A:
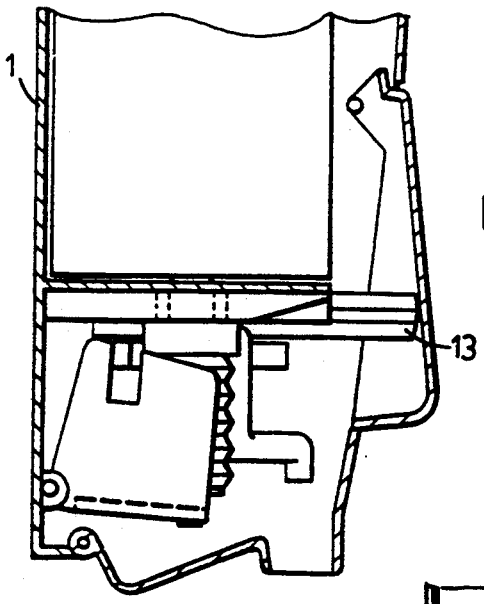
Figure 1B:
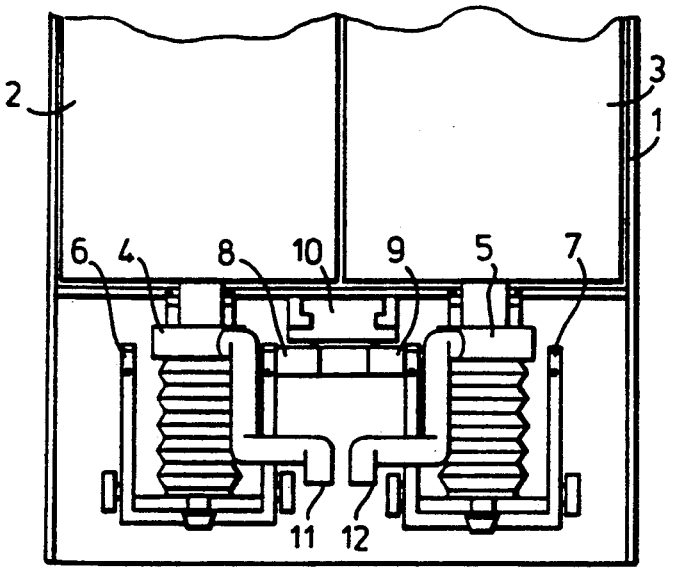
Figure 1C:
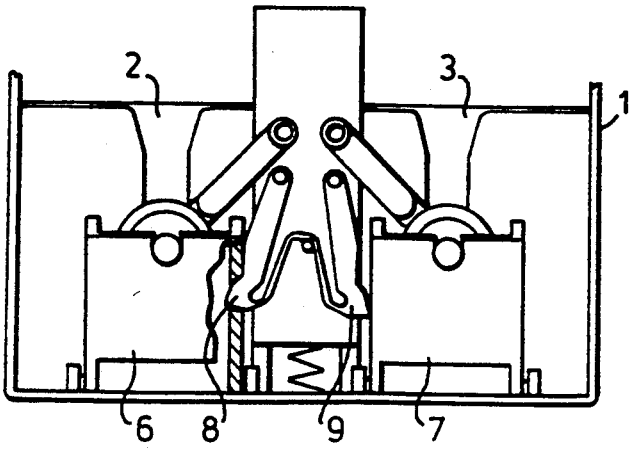

FIGS. 1 A, B and C show three schematic cross-sectional views of the dual dispensing system of the invention. The dual dispenser of the invention features a housing 1 surrounding two separate collapsible reservoirs 2, 3 for holding the liquid soap product. Although there are two reservoirs, only one of them is operative at a time. In the depicted situation this is reservoir 2. Each reservoir is connected to its own pump 4, 5 which is preferably a bellow-type pump. The bellow-type pumps are preferred because they are very compact and they can be used for larger volumes of up to 10 ml and more.

Each of the pumps is also provided with an outlet nozzle 11, 12 through which the liquid soap is to be dispensed.

Figure 2A:
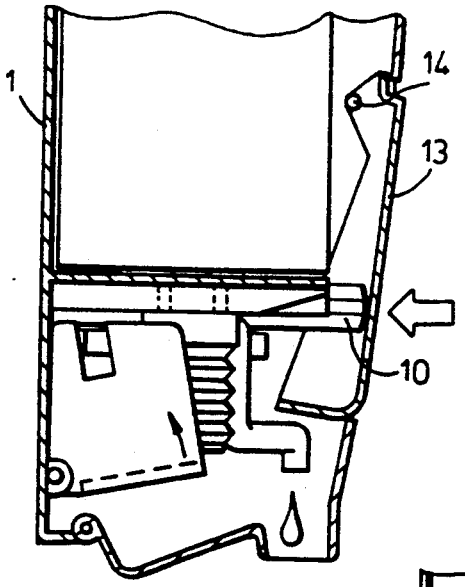
Figure 2B:
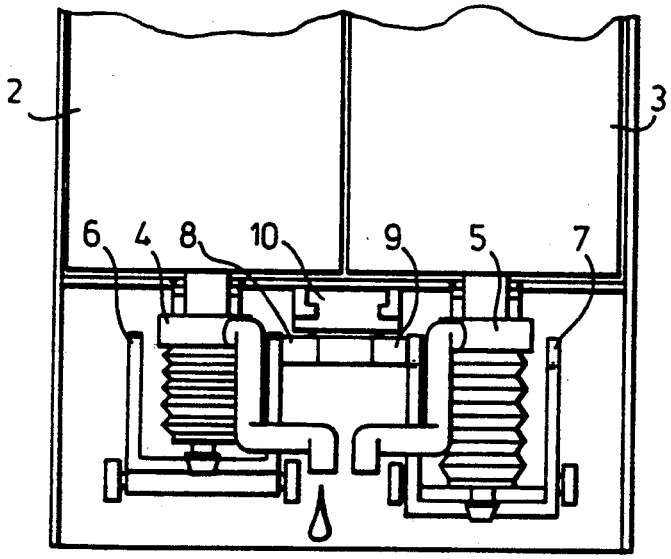
Figure 2C:
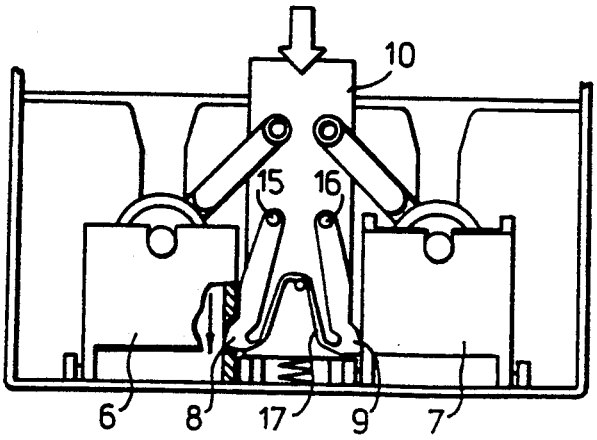

In FIGS. 2 A, B and C is shown what happens upon pressing the operating lever or press bar 13 which is situated at the front of the dispenser, as indicated by the arrow. The press bar is mounted on a hinge 14. The action of the press bar 13 is transferred on to a push rod 10 which is movable in a horizontal direction and acts against a spring. Attached to the push rod 10 there are provided two switch bars 8, 9 which can be pivoted around two vertical axes 15, 16 and which are kept apart by a spring means 17. A notch in one of the switch bars fits into either one of two holes in the other switch bar, thus constituting a bi-stable ensemble. The ensemble of the switch bars is at all times preferably in one of two possible states, corresponding to the states in which either one of the reservoirs is engaged for dispensing liquid soap.

It should be mentioned here that although reference is made here to liquid soap, it is to be understood that the dispenser is in fact suitable for any liquid, gel or paste-like product, for cleaning or sanitizing purposes or even for other products like food products, for instance mayonnaise, all within the scope of the present invention.

In each of the two above-mentioned states, on of the switch bars 8, 9 engages with one of the tilting tables 6, 7 by means of a notch in the switch bar fitting into a hole in the corresponding tilting table. The tilting tables are connected to the two bellow pumps 4, 5 in such way that upon tilting the table, the pump is activated and liquid soap is expelled from the outlet nozzle.

Figure 3A:
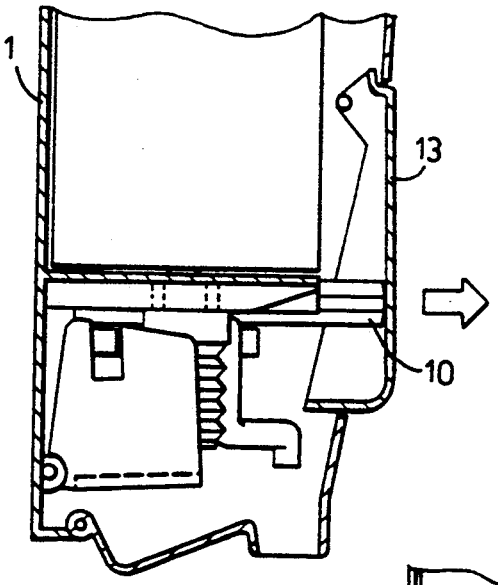
Figure 3B:
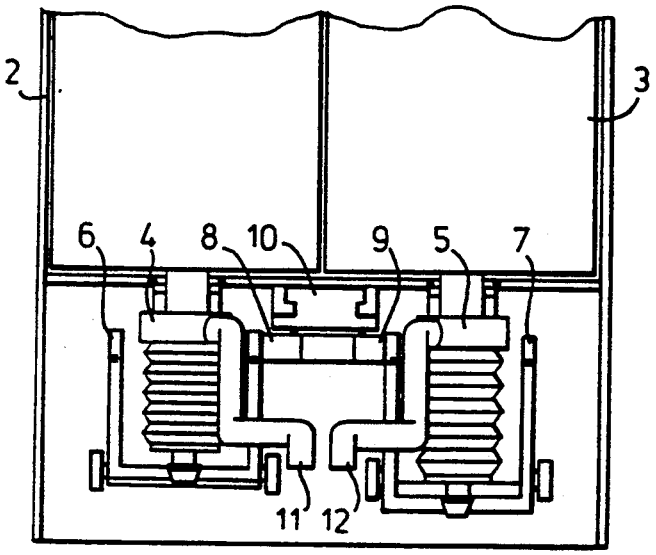
Figure 3C:
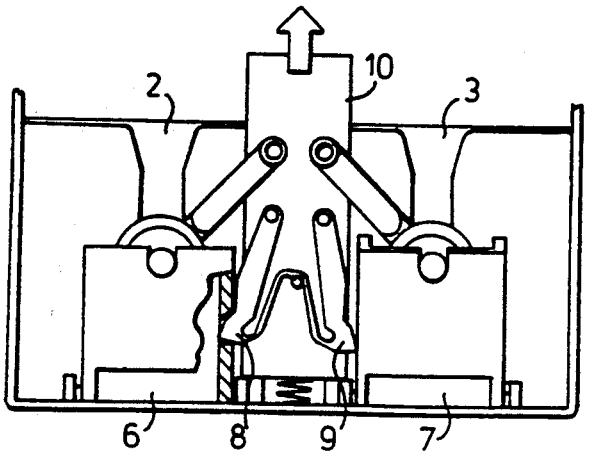

In FIGS. 3 A, B and C the press bar 13 is released. The push rod 10 which acts against a spring, is then also released and will move in the direction indicated by the arrow. The switch bar 8 is engaged in the tilting table 6 and the horizontal movement of the push rod 10 is thereby transformed into a vertical movement of the bellow pump 4. Thereby new liquid soap is sucked into the bellow pump from reservoir 2.

When the press bar 13 is pressed again, the process is repeated and a new aliquot of liquid soap is dispensed from the outlet 11. This may continue until the liquid soap in reservoir 2 runs out.

Figure 4A:
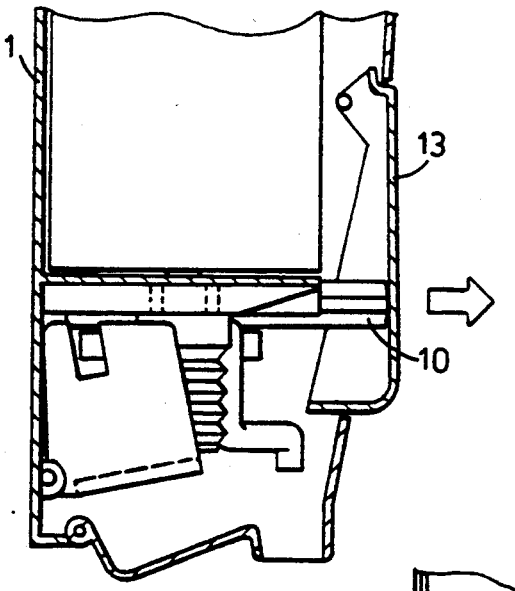
Figure 4B:
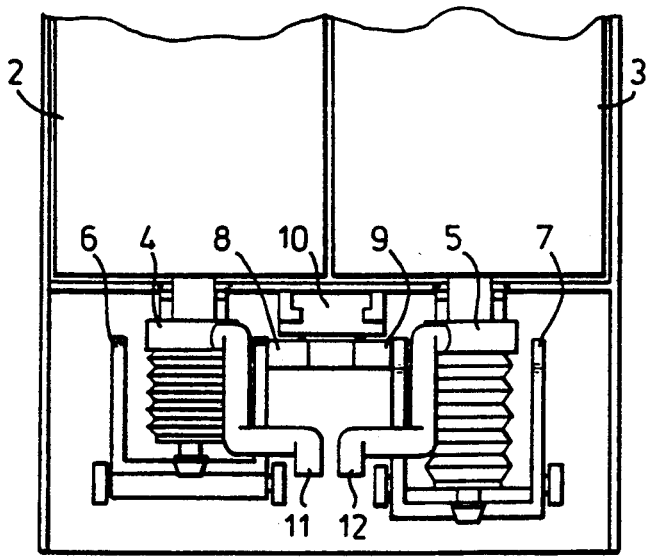
Figure 4C:
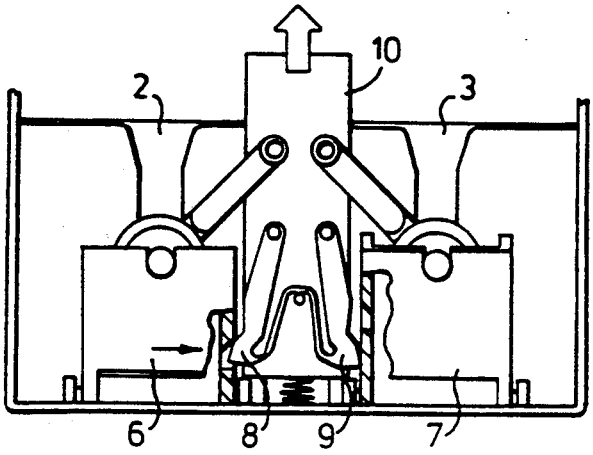

In FIGS. 4 A, B and C the situation is shown wherein the press bar 13 is returning to its outward position, after the last aliquot of liquid soap has been dispensed from reservoir 2. The bellow pump 4 is now unable to suck in new liquid soap from reservoir 2 and remains in the compressed state. The tilting table 6 which is connected to the bellow pump 4 is now retained in the upward position.

Because the push rod 10 is acting against a spring it will tend to return to the outward position. The notch on the switch bar 8 is thereby pushed from the hole in the tilting table 6 and is pushed towards switch bar 9. The tilting table 6 is now uncoupled from switch bar 8.

Figure 5A:
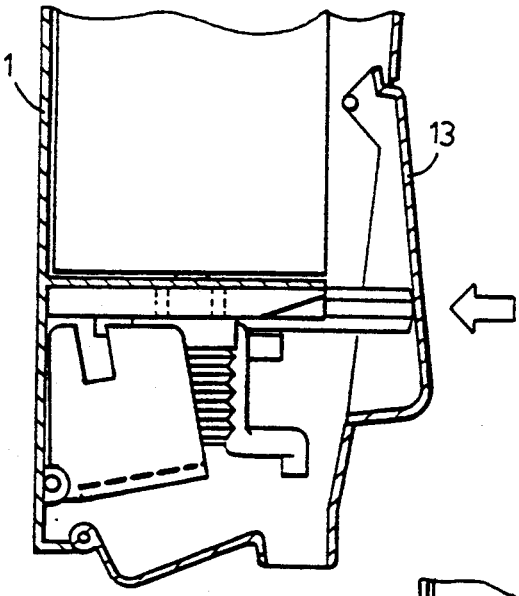
Figure 5B:
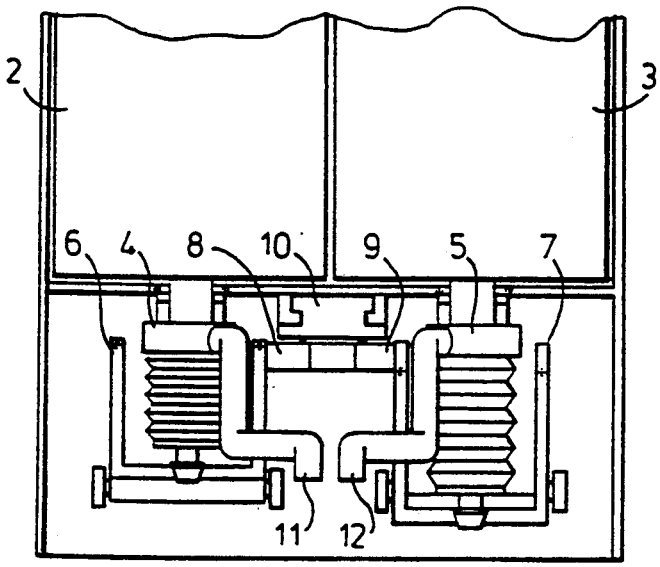
Figure 5C:
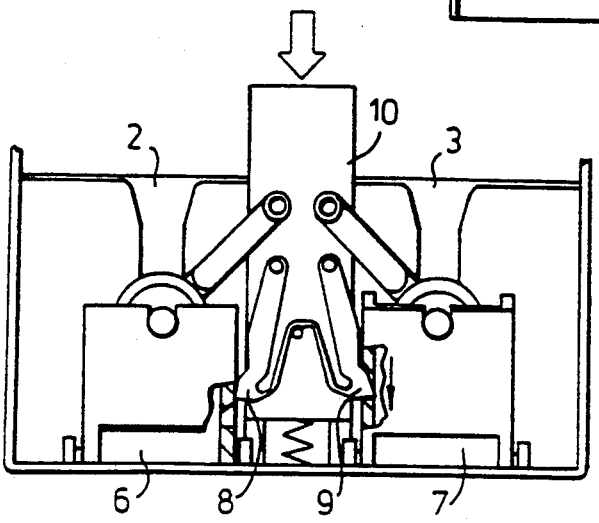

As the push rod 10 is travelling further to its outward position, the notch on the switch bar 9 finds the hole in the tilting table 7 and engages in therein. This is shown in FIGS. 5 A, B and C. The bi-stable ensemble formed by the switch bars 8, 9 is now in its other state, and the switch-over from reservoir 2 to reservoir 3 has taken place. Bellow pump 5 and reservoir 3 are now engaged, and upon pressing the press bar 13, liquid soap is dispensed from reservoir 3 via outlet 12.

This process may be repeated until the liquid soap product in reservoir 3 has run out and a switch-over to reservoir 2 occurs, analogous to the way described above for the switch-over from reservoir 2 to 3. If the empty reservoir 2 has been replaced in the mean time by a new reservoir, the supply of liquid soap from the dispenser is never interrupted. Because the switch-over occurs automatically, the user does not have to draw the attention of an operator if the liquid soap in one of the reservoirs runs out.

The dispenser of the invention has a much lower probability to be empty at a particular moment in time, than the conventional liquid soap dispensers. In order to further reduce the probability, the dispenser may be equipped with indicating means to indicate that a switch-over has occurred. The operator will then be able to determine whether one of the reservoirs has run out of liquid soap without having to open the dispenser.

The indicating means preferably are visual indicating means. The indicating means may comprise two arms, each being connected to one of the tilting tables 6, 7. As shown above, a tilting table will remain in the upward position when the corresponding reservoir is empty. The arms comprise a signalling part which is visible from the outside when the tilting table is in its upward position, and when one of the reservoirs is empty. When the empty reservoir is replaced by a new one, the corresponding tilting table is moved into its downward position and the signalling part will automatically disappear.

It is emphasized that the dispenser shown in the Figures illustrates a only preferred embodiment of the invention and that various constructional alternatives will be immediately evident to the man skilled in the art, without departing from the scope of the present invention.

We claim:

1. A method for using a dual dispensing system, comprising:

(a) providing a housing;

(b) locating two collapsible reservoirs for containing liquid product within the housing;

(c) providing first and second compressible pump means for dispensing the liquid product from the two reservoirs;

(d) connecting the first pump means to one of the reservoirs and connecting the second pump means to the other reservoir;

(e) causing at least one of said first and second compressible pump means to remain in a compressed state by the generation of a vacuum condition in the respective reservoir by emptying the reservoir with its pump;

(f) providing a first tilting table means for compressing the first pump means and affixing it thereto;

(g) providing a second tilting means for compressing the second pump means and affixing it thereto;

(h) providing an operating means for operating one or the other of said first and second tilting table means; and wherein said common operating means includes:

(1) a depressible actuator;

(2) a first actuating means movably mounted to said depressible actuator and releasably engaged to said first tilting table means for moving said first tilting table means when engaged therewith and said actuator is depressed;

(3) a second actuating means movably mounted to said depressible actuator and releasably engaged to said second tilting table means for moving said second tilting table means when engaged therewith and said actuator is depressed; and (i) providing a switch over means which includes: the occurrence of said vacuum condition in one of said reservoirs, and at least a portion of, a corresponding one of said first and second tilting table means and a corresponding one of said first and second actuating means, for automatically moving one of said first and second actuating means out of engagement with tis respective tilting table means and for moving the other of said first and second actuating means into engagement with its respective tilting table means.

2. A dual dispensing system for delivering aliquots of a liquid product comprising:

(a) a housing;

(b) two collapsible reservoirs for containing liquid product within the housing;

(c) first and second compressible pump means for dispensing the liquid product from the two reservoirs, the first pump means being connected to one of the reservoirs and the second pump means being connected to the other reservoir, said first and second compressible pump means remaining in a compressed state upon the respective reservoirs generating a vacuum condition by becoming substantially empty and substantially collapsed;

(d) a first tilting table means for compressing the first pump means and being affixed thereto;

(e) a second tilting table means for compressing the second pump means and being affixed thereto;

(f) operating means for operating one or the other of said first and second tilting table means; said common operating means including:

(1) a depressible actuator;

(2) a first actuating means movably mounted to said depressible actuator and releasably engaged to said first tilting table means for moving said first tilting table means when engaged therewith and said actuator is depressed;

(3) a second actuating means movably mounted to said depressible actuator and releasably engaged to said second tilting table means for moving said second tilting table means when engaged therewith and said actuator is depressed; and (g) switch over means which includes: said vacuum condition in one of said reservoirs, and at least a portion of, a corresponding one of said first and second tilting table means and a corresponding one of said first and second actuating means, for automatically moving one of said first and second actuating means out of engagement with its respective tilting table means and form moving the other of said first and second actuating means into engagement with its respective tilting table means.

3. A dual dispensing system as set forth in claim 2, wherein said first and second actuating means comprise switch bars.

4. A dual dispensing system as set forth in claim 2, wherein said first pump means and said second pump means comprise bellow pumps.

5. A dual dispensing system as set forth in claim 2, wherein said first pump means and said second pump means have a capacity of about 0.1 to 10 ml.

6. A dual dispensing system as set forth in claim 2, wherein said first pump means and said second pump means have a capacity of about 1 to 5 ml.

* * * * *

UNITED STATES PATENT AND TRADEMARK OFFICE

CERTIFICATE OF CORRECTION

PATENT NO. : 5,242,081
DATED : September 7, 1993
INVENTOR(S) : Van der Heyden, et al.

It is certified that error appears in the above-indentified patent and that said Letters Patent is hereby corrected as shown below:

On the title page, item (75) inventors; "van der He den et al." should read --Lambertus G. Van der Heyden--.

Item (19) should read --Van der Heyden et al.--

Signed and Sealed this

Twenty-eighth Day of June, 1994

*Attest:*

Bruce Lehman

BRUCE LEHMAN

*Attesting Officer*

*Commissioner of Patents and Trademarks*